US006981481B2

(12) United States Patent
Kojima et al.

(10) Patent No.: US 6,981,481 B2
(45) Date of Patent: Jan. 3, 2006

(54) STARTING DEVICE FOR INTERNAL COMBUSTION ENGINE

(75) Inventors: Susumu Kojima, Shizuoka-ken (JP); Kei Masuda, Shizuoka-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 73 days.

(21) Appl. No.: 10/790,084

(22) Filed: Mar. 2, 2004

(65) Prior Publication Data

US 2004/0200448 A1 Oct. 14, 2004

(30) Foreign Application Priority Data

Apr. 11, 2003 (JP) ..... 2003-107961

(51) Int. Cl.
*F02N 11/08* (2006.01)

(52) U.S. Cl. ..... 123/179.3

(58) Field of Classification Search ..... 123/179.5, 123/179.4, 179.3, 179.1
See application file for complete search history.

(56) References Cited

U.S. PATENT DOCUMENTS 4,462,348 A * 7/1984 Giardini ..... 123/179.1
5,485,127 A * 1/1996 Bertoluzzi et al. ..... 331/69
5,495,127 A 2/1996 Aota et al.
6,050,232 A * 4/2000 Grob et al. ..... 123/179.16
6,098,585 A * 8/2000 Brehob et al. ..... 123/179.5
6,588,397 B1 7/2003 Sieber
6,647,955 B1 * 11/2003 Sieber ..... 123/322
6,681,173 B2 * 1/2004 Turner et al. ..... 701/113
6,718,928 B2 * 4/2004 Brueggen et al. ..... 123/179.5
6,807,934 B2 * 10/2004 Kataoka et al. ..... 123/179.4
2003/0101956 A1 6/2003 Sieber
2003/0121487 A1 * 7/2003 Koseki et al. ..... 123/179.3
2004/0055553 A1 * 3/2004 Asaka et al. ..... 123/179.3

FOREIGN PATENT DOCUMENTS

| | | |
|---|---|---|
| JP | A 2002-4929 | 1/2002 |
| JP | A 2002-4985 | 1/2002 |
| JP | A 2002-39038 | 2/2002 |
| JP | A 2002-317740 | 10/2002 |
| JP | A 2003-515052 | 4/2003 |
| JP | A 2003-532005 | 10/2003 |

* cited by examiner

*Primary Examiner*—Henry C. Yuen
*Assistant Examiner*—Arnold Castro
(74) *Attorney, Agent, or Firm*—Oliff & Berridge, PLC

(57) ABSTRACT

A stating device for an internal combustion engine predicts whether a starter is required to assist a crank of the engine before igniting fuel in a cylinder in an expansion stroke, and starts the starter before igniting the fuel in a cylinder in an expansion stroke if it is decided that the starter is required.

20 Claims, 7 Drawing Sheets

STARTING DEVICE FOR INTERNAL COMBUSTION ENGINE

BACKGROUND OF THE INVENTION

1) Field of the Invention

The present invention relates to a starting device for an internal combustion engine. More specifically, the present invention relates to deciding whether to provide the internal combustion engine with assistance using a starter.

2) Description of the Related Art

A typical cylinder injection type internal combustion engine (hereinafter, "engine") has cylinders with combustion chambers. To start the engine, which is at rest, fuel is injected and ignited into the combustion chamber of a cylinder in an expansion stroke (hereinafter, "expansion-stroke-cylinder"). The fuel burns and produces combustion energy. The combustion energy is used to obtain the power to start the engine. However, the combustion energy alone is sometimes insufficient to start the engine. Various solutions have been proposed to solve this problem.

Japanese Patent Application Laid Open No. 2002-4985 discloses a conventional starter device. In the conventional technology, when the engine is at rest, an expansion-stroke-cylinder is detected, and fuel is injected and ignited into the expansion-stroke-cylinder. Moreover, if the engine does not start because of insufficient combustion energy, a motor is used to assist the cranking to reliably start the engine.

Japanese Patent Application Laid Open No. 2002-39038 and Japanese Patent Application Laid Open No. 2002-4929 disclose other conventional technologies.

Thus, conventionally, the fuel is injected and ignited into the expansion-stroke-cylinder, and it is determined whether the engine is going to start properly, and if the engine is not going to start, a starter is used to assist the starting of the engine. In other words, whether to use the starter is decided after confirming that the engine is not going start.

However, because whether to use the starter is decided after confirming that the engine is not going to star, a time lag is produced between a theoretical timing of starting of the starter and the real time of starting of the starter. As a result, sometimes the engine does not start.

SUMMARY OF THE INVENTION

It is an object of the present invention to solve at least the problems in the conventional technology.

A starting device according to an aspect of the present invention is for an internal combustion engine that ignites fuel in an expansion-stroke-cylinder that is a cylinder in an expansion stroke from among a plurality of cylinders of the internal combustion engine to start the internal combustion engine. The starting device includes a predicting unit that predicts a state of a crank of the cylinders if the fuel in the expansion-stroke-cylinder is ignited; and a determining unit that determines whether to start a starter to assist movement of the crank based on the state predicted.

A method according to another aspect of the present invention is a method of starting an internal combustion engine that includes igniting fuel in an expansion-stroke-cylinder that is a cylinder in an expansion stroke from among a plurality of cylinders of the internal combustion engine to start the internal combustion engine. The method includes predicting a state of a crank of the cylinders if the fuel in the expansion-stroke-cylinder is ignited; and determining whether to start a starter to assist movement of the crank based on the state predicted.

The other objects, features, and advantages of the present invention are specifically set forth in or will become apparent from the following detailed descriptions of the invention when read in conjunction with the accompanying drawings.

DETAILED DESCRIPTION

Exemplary embodiments of a starting device according to the present invention are explained in detail below with reference to the accompanying drawings. The present invention is not limited to following embodiments.

The present invention relates to operating a cylinder direct injection gasoline engine (hereinafter, "engine") by directly injecting fuel into cylinders of the engine and igniting the fuel by generating a spark. The engine is started in the following manner. That is, when the engine is at rest, a stop position (or a rotational angle position) of a crank (or crankshaft) in each cylinder is detected to decide whether the cylinder is an expansion-stroke-cylinder, and the fuel is injected into the expansion-stroke-cylinder and the fuel is ignited after a lapse of a predetermined vaporization period. Subsequently, fuel is injected into a cylinder (hereinafter, "follower cylinder") that follows the expansion-stroke-cylinder and the fuel is ignited when a piston of the follower cylinder exceeds a top dead center (hereinafter, "TDC") of a compression stroke by initial combustion in the expansion-stroke-cylinder. Subsequently, the fuel in the cylinders those follow the follower cylinder is successively is ignited. This process causes the fuel in the cylinders to ignite one after the other and start the engine.

In a first embodiment of the present invention, before starting the engine, an amount of a cranking of the crank due to the combustion of the fuel in the expansion-stroke-cylinder (hereinafter, "initial combustion") is predicted from a temperature of coolant in the engine (or state of air in the cylinder, or air density) and the stop position (stop angle) of the crank. Moreover, if the amount of the cracking is such that the initial combustion is insufficient to cause the piston of the follower cylinder to exceed the TDC of the compression stroke, the starter motor is started after the crank starts to rotate due to the initial combustion.

The present invention utilizes the fact that to start the engine without assistance from an external power it is essential that the piston of the follower cylinder exceeds the TDC of the compression stroke by the initial combustion to cause combustion of the fuel in the follower cylinder (hereinafter, "second combustion") and combustion of the fuel in the cylinders thereafter.

Whether the piston of the follower cylinder is going to exceed the TDC can be determined from (1) combustion power and (2) frictional force (or rotational resistance). The inventers of the present invention obtained the following findings as a result of a series of experiments and hard work. The findings are explained below with reference to FIG. 4.

(1) Combustion Power

Figure 4:
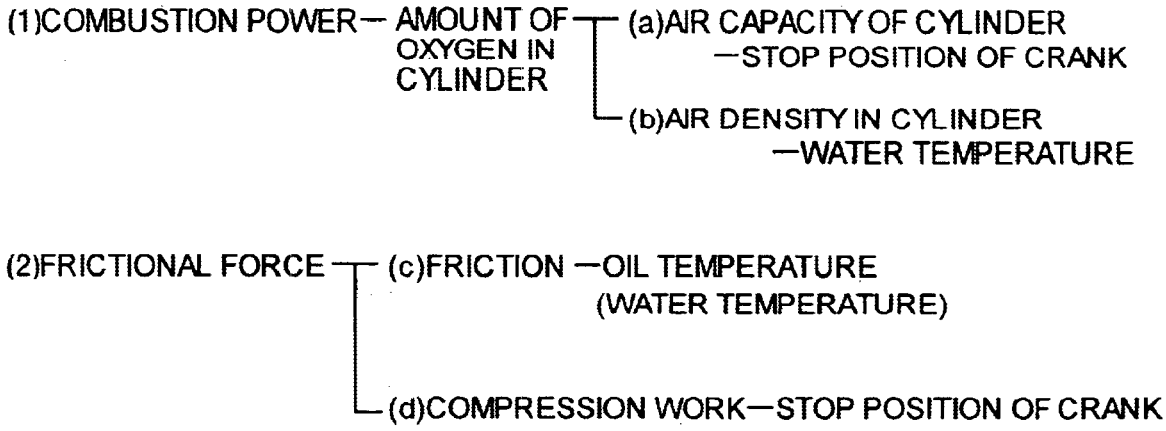
FIG. 4 is to explain the factors that are used to predict rotational angle of the crank in the first embodiment.

The combustion power produced is proportional to the amount of oxygen in the cylinder (see (1) in FIG. 4). The amount of oxygen in the cylinder depends on (a) air capacity of the cylinder and (b) air density in the cylinder. The air capacity of the cylinder depends on the stop position of the crank. The air density in the cylinder can be obtained from a temperature of the coolant (hereinafter, "water temperature") in the engine. If the water temperature is high, the air density in the cylinder shall be low. At a particular stop position of the crank, the amount of oxygen in the cylinder is directly proportional to the air density in the cylinder, the combustion power is directly proportional to the amount of oxygen in the cylinder, and the air density is inversely proportional to the water temperature. In other words, the combustion power drops as the water temperature rises.

(2) Frictional Force

The frictional force is proportional to (c) friction due to viscosity of a lubricating oil in the engine and (d) compression work in the follower cylinder (see (2) in FIG. 4). The friction due to the viscosity of the lubricating oil is troublesome mainly in a valve operating system, and the Inventors found that a specific relationship exists between the friction due to the viscosity and temperature of the oil in the engine (which is generally same as the water temperature). The Inventors also found that a specific relationship exists between the compression work in the follower cylinder and the stop position of the crank.

Figure 1:
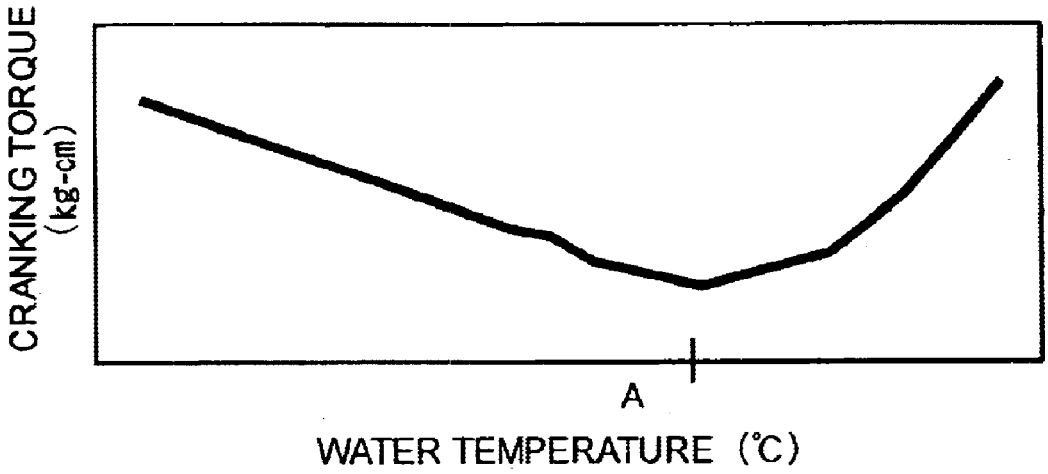
FIG. 1 is a graph that illustrates how the cranking torque of an engine changes with the water temperature in a first embodiment of the present invention.

FIG. 1 is a graph that illustrates how the cranking torque of the engine changes with the water temperature. The cranking torque is required to start the engine is minimum when the water temperature is in a half warmed state, that is, when the water temperature is at around A° C. More cranking torque is required to start the engine when the water temperature is above or below A° C.

The oil temperature lowers if the water temperature is below A° C., and accordingly the viscosity of the oil (viscosity coefficient) increases. However, as the oil becomes more viscous, it exerts a friction so that the cranking torque increases. Thus, if the water temperature is below A° C., higher cranking torque is required to start the engine.

The viscosity of the oil drops as the water temperature rises above A° C. to cause a lubricating surface to change from a fluid phase to a solid phase (oil film breakage), and thereby the friction increases. Thus, if the water temperature is above A° C., again higher cranking torque is required to start the engine.

FIG. 1 relates to a case when the number of revolutions of the crank is lower than those during a normal operation (i.e., when the engine is operating). Such a condition is fulfilled when the engine is at rest or almost at rest. Because the present invention relates to staring the engine, the case to which FIG. 1 relates is in the scope of the present invention. During the normal operation the number of revolutions is high so that oil film breakage occurs when the water temperature is above A° C. A graph that illustrates how the cranking torque of the engine changes with the water temperature during normal operation can be obtained by horizontally shifting the curve in FIG. 1 towards right.

Because the present invention relates to staring of an engine and the engine rotates slowly while stating than during the normal operation, the graph in FIG. 1 relates to the present invention. When the engine rotates slowly, the lubricating oil is hard to slide between the surfaces of the cylinder and the piston so that oil film breakage occurs when the water temperature is around A° C.

Figure 2:
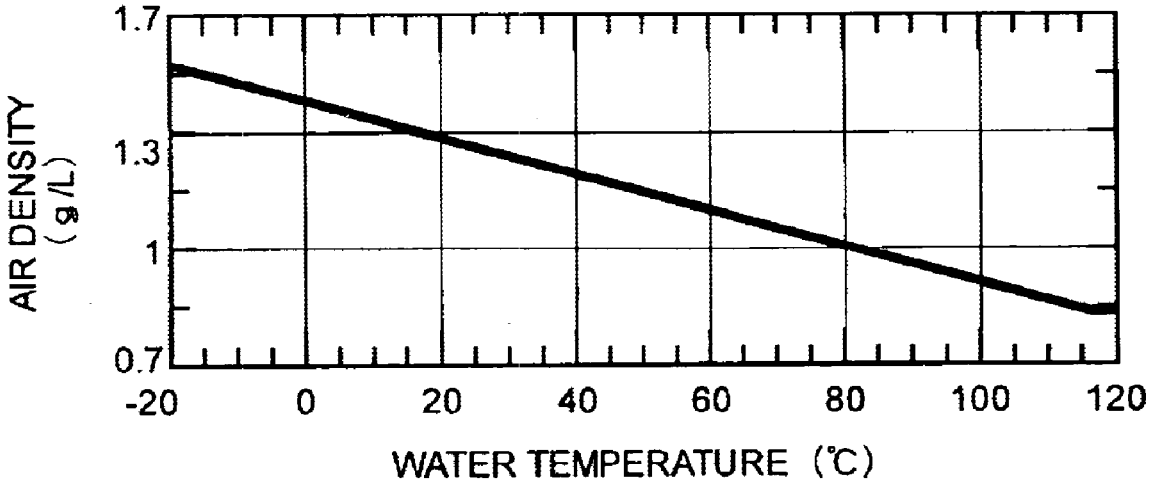
FIG. 2 is a graph that illustrates how the air density changes with the water temperature in the first embodiment.

FIG. 2 is a graph that illustrates how the air density in the cylinder changes with the water temperature. The air density is inversely proportional to the water temperature. The amount of oxygen in the air decreases as the air density decreases, and the combustion power decreases as the amount of the oxygen in the air decreases. In other words, the combustion power decreases as the water temperature rises above A° C.

Figure 3:
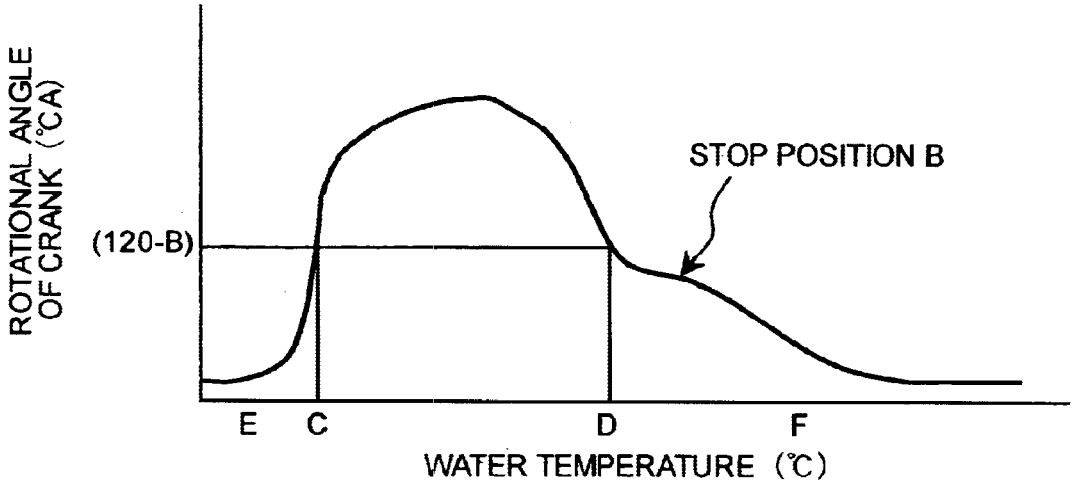
FIG. 3 is a graph that illustrates how the rotational angle of a crank changes, in an expansion-stroke-cylinder, by an initial combustion, with the water temperature in the first embodiment.

FIG. 3 is a graph of experimental results that illustrate how the rotational angle of a crank changes in the expansion-stroke-cylinder by an initial combustion with the water temperature. In other words, FIG. 3 illustrates experimental results on how the rotational angle of the crank (° CA) in the expansion-stroke-cylinder changes as the water temperature rises due to the initial combustion in the expansion-stroke-cylinder.

The characteristic as shown in FIG. 3 are obtained due to the change in the friction, which is explained with reference to FIG. 1, and the change in the combustion power, which is explained with reference to FIG. 2.

Data about water temperature and rotational angle of the crank was acquired and mapped previously at each stop position of the crank. The data for the rotational angle of the crank includes data for combustion power and frictional force. In other words, data for the rotational angle of the crank, the combustion power, and the frictional force was acquired in the experiment. When the engine is to be started, by referring to the map, it is determined, from the stop position of the crank and the water temperature, whether the engine will start without the assistance of the starter.

In the experiment, an inline six-cylinder type engine was targeted in which crank angles of adjacent cylinders were displaced by 120 degrees CA with respect to each other. In FIG. 3, a stop position B means an angle of the crank of an expansion-stroke-cylinder, i.e., stop position of the crank.

FIG. 3 corresponds to a case in which a stop position of the expansion-stroke-cylinder is the stop position B. Consequently, the stop position of the crank of the follower cylinder, which is displaced by 120 degrees with respect to the expansion-stroke-cylinder, is (B-120) degrees. In other words, to satisfy the condition that the piston of the follower cylinder exceeds the TDC of the compression stroke, the rotational angle of the crank in the expansion-stroke-cylinder due to the initial combustion in the expansion-stroke-cylinder has to be (120-B) degrees or higher. Whether the rotational angle of the crank in the expansion-stroke-cylinder due to the initial combustion is (120-B) degrees or higher is determined by referring to the map (FIG. 3). From the map, it can be understood that, when the water temperature is between C° C. and D° C., the rotational angle of the crank in the expansion-stroke-cylinder due to the initial combustion is (120-B) degrees or higher. In other words, if the water temperature is between C° C. and D° C., the piston of the follower cylinder shall exceed the TDC of the compression stroke.

Therefore, if the water temperature of the engine is between C° C. and D° C., it is determined that the engine can be started without the starter. On the other hand, if the water temperature is lower than C° C. or higher than D° C., it is determined that the starter is required to assist the starting of the engine.

It can be noticed in FIG. 3 that the rotational angle of the crank rapidly decreases when the water temperature is around D° C. This happens because the piston of the follower cylinder exceeds the TDC of the compression stroke when the water temperature is at around D° C. When the water temperature is at around D° C., even a slight change in the combustion power and the frictional force causes an abrupt change in the rotational angle of the crank. Therefore, in order to ensure a safety margin, it may be determined that the starter is not required to assist the starting of the engine if the water temperature is a little lower than D° C.

Thus, in the first embodiment, the stop position of the crank of the follower cylinder is obtained from the stop position of the crank of the expansion-stroke-cylinder, and from the stop position obtained, the rotational angle of the crank of the expansion-stroke-cylinder required for the piston of the follower cylinder to exceed the TDC of the compression stroke (for starting the engine without external-power assist) is obtained.

Experiments are conducted with an engine to previously obtain the graph shown in FIG. 3 at each stop position of cranks (FIG. 6) in each cylinder, and the data is mapped. By referring to the map, the rotational angle of the crank by the initial combustion in the expansion-stroke-cylinder can be obtained based on the stop position of the crank for the expansion-stroke-cylinder and the water temperature. The rotational angle of the crank, that is, a predicted rotational angle of the crank by initial combustion in the expansion-stroke-cylinder is obtained by referring to the map. If the rotational angle of the crank is larger than the rotational angle of the crank required for the piston in the follower cylinder to exceed the TDC of the compression stroke, it is determined that the engine can be started without external assistance.

On the contrary, if the predicted rotational angle of the crank by the initial combustion in the expansion-stroke-cylinder is smaller than the rotational angle of the crank required for the piston in the follower cylinder to exceed the TDC of the compression stroke, it is determined that the external assistance is necessary to start the engine.

In the first embodiment, whether the predicted rotational angle is smaller or larger than the rotational angle of the crank required for the piston in the follower cylinder to exceed the TDC of the compression stroke can be determined even before staring the engine so that the starter can be starting at an optimal timing.

Figure 5:
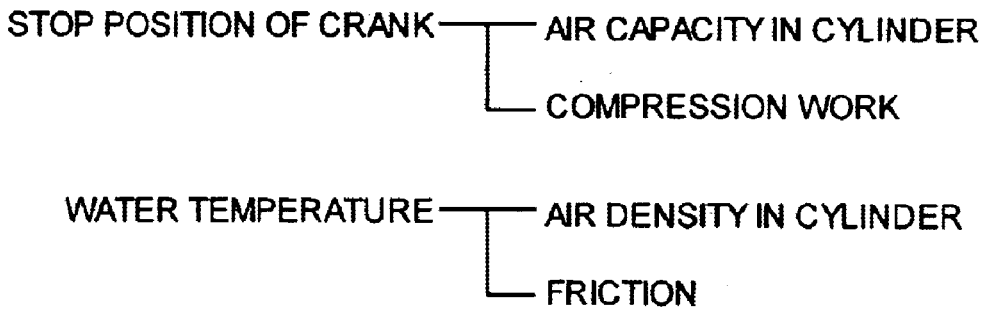
FIG. 5 is to explain the factors that can be obtained from the factors detected in the first embodiment.

If the stop positions of the crank representing the air capacity of the cylinder and the compression work in the follower cylinder are the same as each other (FIG. 4 and FIG. 5), the rotational angle of the crank due to the initial combustion can be predicted by the water temperature representing the air density and the oil viscosity. Note that the information in FIG. 5 is rewritten from the relation in FIG. 4, centering on the stop position of the crank and the water temperature.

If the stop position of the crank changes, the amount of compression work in the follower cylinder and the air capacity in the cylinder change to cause the rotational angle of the crank by the initial combustion to change.

Figure 6:
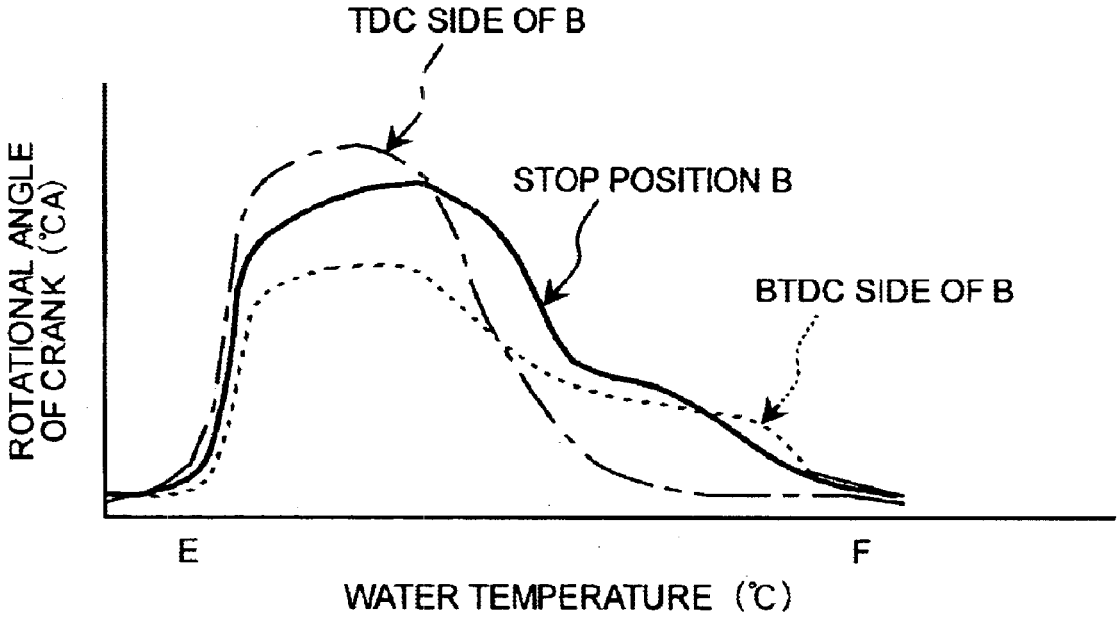
FIG. 6 is a graph that illustrates how at respectively a stop potion B, a TDC side of B, and a BTDC side of B the rotational angle of a crank changes with the water temperature in the first embodiment.

FIG. 6 is a graph of data in cases where the stop positions of the crank are the stop position B, the TDC side of the stop position B, and the before top dead center (BTDC) side of the stop position B. A relation between the water temperature and the rotational angle of the crank according to respective stop positions of the clank is previously measured to prepare a map. The rotational angle of the crank can be predicted based on the water temperature and the stop position of the crank by referring to the map. It is thereby possible to predict whether the piston of the follower cylinder can exceed the TDC of the compression stroke only by the initial combustion based on the predicted rotational angle of the crank.

As shown in FIG. 6, different stop positions of the crank require uses of different thresholds (water temperature).

Although it is mentioned here to obtain the air density and the oil viscosity from the water temperature as shown in FIG. 4 and FIG. 5, the air density and the oil viscosity may be obtained using other parameter(s) or may be obtain using the water temperature and other parameter(s).

For example, the other parameters include, for example, the time duration (hereinafter, "leaving time") for which the engine is in the a stop state. The temperature distribution immediately after the engine is stopped is narrow because a coolant is cycled along a water gallery of the engine so that the temperature in the cylinder (cylinder temperature) is not very different from the temperature of the coolant (coolant temperature) measured with a temperature sensor. However, due to the radiation of heat, the cylinder temperature differs from the coolant temperature with the leaving time. Moreover, due to evaporation of residual fuel during the leaving time, the air density also varies with leaving time.

Therefore, although the water temperatures detected by the temperature sensor of two engines are the same, but if the leaving times are different, the air densities and the oil viscosities shall be different. Therefore to obtain better results, it is preferable that data is measured and mapped for each leaving time. On the other hand, the data may be multiplied by a constant of proportionality that depends on the leaving time to obtain data that corresponds to the leaving time.

Figure 7:
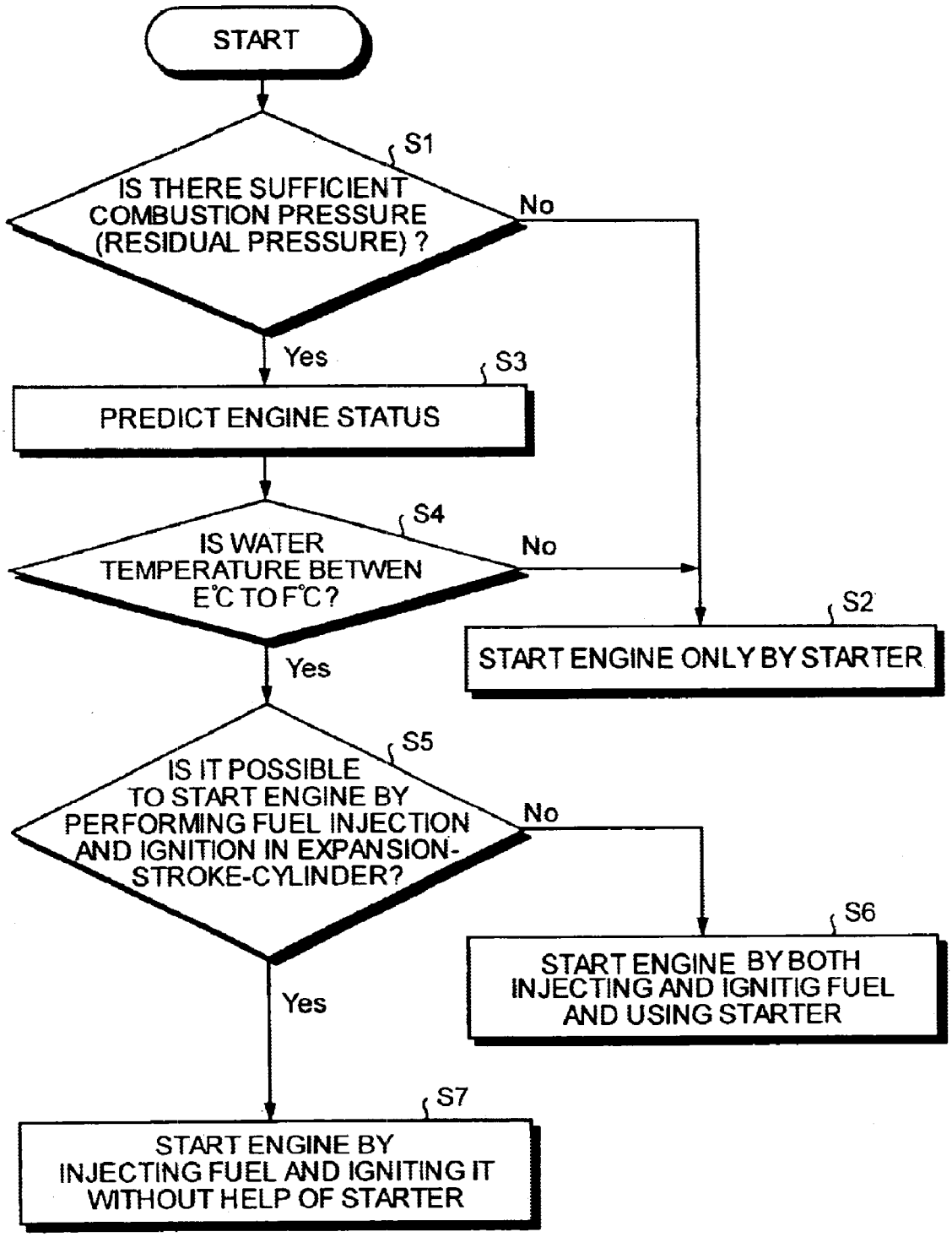
FIG. 7 is a flowchart of a process procedure performed by a starting device according to the first embodiment.

FIG. 7 is a flowchart of an operation of the first embodiment. At step S1, it is determined whether there is fuel pressure of a predetermined value or higher (fuel pressure: residual pressure) in the side of delivery pipe (fuel passage).

Pressure is applied to fuel by an electric pump in the port injection engines. However, it is difficult to inject the fuel into a cylinder using the pressure by the electric pump so that a mechanical pump is used when in the direct injection engines (cylinder injection type internal combustion engines). The mechanical pump is started in response to starting of the engine to apply the pressure to the fuel. In other words, in the direct injection engines, pressure is not applied to the fuel when the engine is at rest.

On the other hand, in the first embodiment, when the engine is stopped for a short time such as an idling stop in an economy running system, it is assumed that the residual pressure remains in the delivery pipe. As explained above, only when the fuel pressure remains in the direct injection engine, it is possible to send the fuel by the fuel pressure and inject the fuel into the expansion-stroke-cylinder. That is why presence or absence of the residual pressure is determined at step 1.

If it is determined that the residual pressure is less than the predetermined value ("No" in step S1), the engine is started using only the starter, i.e., without performing the fuel injection and ignition in the expansion-stroke-cylinder (step S2). Because, as the residual pressure in the expansion-stroke-cylinder is insufficient, it is impossible to rotate the crank satisfactorily even if the fuel injection and ignition are performed.

If it is determined that the residual pressure is equal to or higher than the predetermined value ("Yes" in step S1), the system control passes to step S3.

At step S3, the rotational angle of the crank by initial combustion in the expansion-stroke-cylinder is predicted based on the water temperature and the stop position of the crank using the map with the data of FIG. 6 registered therein.

At step S4, it is determined whether the water temperature is between E° C. and F° C. If the water temperature is too low, i.e., less than E° C., or the water temperature is too high, i.e., higher than F° C., the crank cannot be made to rotate satisfactorily even if the fuel injection and ignition are performed in the expansion-stroke-cylinder.

If the water temperature is not between E° C. and F° C. ("No" in step S4), the engine is started using only the starter, i.e., without performing the fuel injection and ignition in the expansion-stroke-cylinder (step S2).

If the water temperature is between E° C. and F° C. ("Yes" in step S4), the system control passes to step S5.

The graph in FIG. 3 can be roughly divided into three areas. A first area corresponds to a case when the water temperature is not between E° C. and F° C. A second area corresponds to a case where the water temperature is between E° C. and F° C. but the rotational angle of the crank is short although the crank is made to rotate by the initial combustion so that assistance of the starter is required. A third area corresponds to a case where the water temperature is between E° C. and F° C. and the crank rotates until the piston in the follower cylinder exceeds the TDC of the compression stroke only by the initial combustion so that assistance of the starter is not required.

At step S5, it is predicted whether the piston in the follower cylinder exceeds the TDC of the compression stroke only by the initial combustion in the expansion-stroke-cylinder. This prediction is performed based on the rotational angle of the crank predicted at step S3 and the rotational angle of the crank required for the piston in the follower cylinder, detected from the stop position of the crank, to exceed the TDC of the compression stroke.

If the piston in the follower cylinder can exceed the TDC of the compression stroke only by the initial combustion in the expansion-stroke-cylinder ("Yes" at step S5), the engine is started only by performing fuel injection and ignition in the expansion-stroke-cylinder, i.e., without using the starter (step S7).

If the piston in the follower cylinder cannot exceed the TDC of the compression stroke only by the initial combustion in the expansion-stroke-cylinder ("No" in step S5), the engine is started both by performing fuel injection and ignition in the expansion-stroke-cylinder and using the starter (step S6).

It is also possible to previously measure the number of revolutions of the engine caused by the initial combustion in the expansion-stroke-cylinder and the changes in the number to prepare them as a map in the same manner as that of the rotational angle of the crank. Therefore, it is possible to predict the number of revolutions and the changes in the number based on the stop position of the crank and the water temperature. Such a map will be explained later as a second embodiment of the present invention.

Thus, it is possible to determine whether the piston in the follower cylinder exceeds the TDC of the compression stroke by the initial combustion, that is, whether starter assist is required, by detecting the water temperature and the stop position of the crank before the engine is started. This scheme provides advantages as follows.

Generally, the starter motor requires a large current for the starting, and therefore, the starter motor is not directly energized, but a magnet switch is turned on by a starter relay to energize the starter motor. Consequently, the starter motor is largely delayed in starting (response delay). The delay in starting ranges from about 0.1 to about 0.3 second. If it is determined whether the starter is required to start after the engine is started and the starter is made to start in response to the result of determination, the optimal starting time may be missed.

In the first embodiment, however, it is possible to decide whether the starter is required before the engine is started. Therefore, even if the starter has some delay in starting, the starter can be made to start (the starter is energized) at the optimal timing by taking into account the delay time. Thus, it is possible to improve the startup performance by the initial combustion in the expansion-stroke-cylinder.

Furthermore, because the rotational angle of the crank and/or the number of revolutions of the engine and the changes in the number are predicted before starting of the engine, the starter can be made to start accordingly. Therefore, it is possible to optimally control the starter.

Moreover, if it is determined that the starter is required to start, the starter is not activated to start the engine when it is at rest unlike in an ordinary manner but is activated to further accelerate the engine already rotating by the initial combustion in the expansion-stroke-cylinder. Therefore, the current consumption is reduced. This has been confirmed in the testing of FIG. 10 explained later.

It has been explained above to determine based on both the combustion power and the frictional force whether the piston in the follower cylinder exceeds the TDC of the compression stroke by the initial combustion. However, if the combustion power is enough stronger, the determination can be performed based on only the magnitude of the combustion power.

The direct injection engine has been explained in the first embodiment, but the present invention is also applicable to a port injection engine. For cranking of the port injection engine, fuel is previously injected into an intake manifold when the crank stops, and at the following step, only ignition is required to rotate the crank. As explained above, for starting the port injection engine; the fuel is injected into the intake manifold when the port injection engine is at rest and an electric pump is used for fuel supply. Therefore, the step of checking the fuel pressure (step S1) of FIG. 7 is not performed, but the engine status is predicted based on the water temperature and the stop position of the crank, the water temperature is checked, and whether the starter is required to start is determined based on the predicted rotational angle of the crank by referring to the map (steps S3 to S5).

The second embodiment of the present invention is explained below with reference to FIG. 8.

The following operation is performed based on the operation of the first embodiment. That is, data (not shown) for the water temperature, the number of revolutions of the engine by the initial combustion in the expansion-stroke-cylinder, and for the changes in the number is previously acquired at each stop position of the crank, and the acquired data is mapped.

If it is determined that the starter is required to start in the manner explained in the first embodiment, a starting timing of the starter motor is obtained for starting the engine by referring to the map prepared in the second embodiment.

Before the engine is started, the number of revolutions of the engine by the initial combustion in the expansion-stroke-cylinder and the changes in the number are predicted based on the water temperature and the stop position of the crank by referring to the map. Based on the result of prediction, the operation starting timing of the starter motor is set so that the starter motor and the engine are engaged with each other in a period during which the rotation of the engine is accelerated by the initial combustion.

It is desirable that the starter motor and the engine are engaged with each other when a difference between their rotational speeds is small. This is because noise produced through engagement between gears of the two and abrasion of the gears can be reduced. The operation starting timing of the starter is controlled (sometimes even the rotational speed is controlled) so as to synchronize to the timing of engaging the gears with each other, that is, to make the rotational speed of the starter identical to that of the engine at the same time or to make smaller the difference between the rotational speeds.

The starter is engaged with the engine while accelerating the starter. Therefore, it is desirable that the engine is also engaged with the starter when the rotation of the engine is accelerated by the initial combustion.

Figure 8:
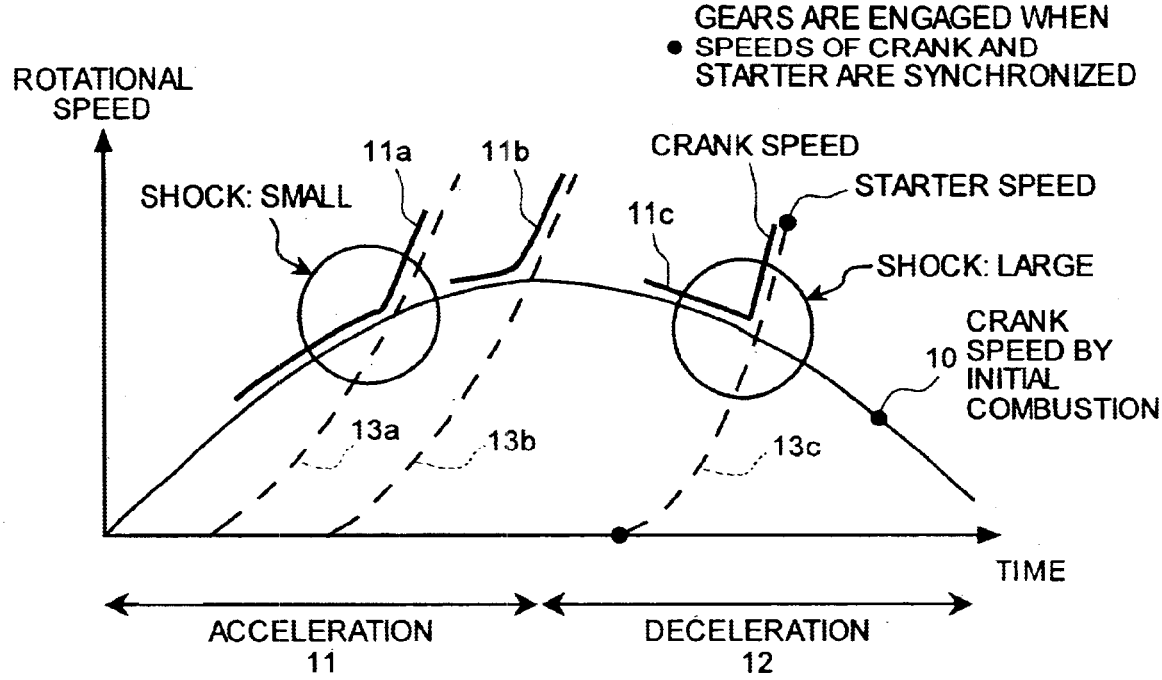
FIG. 8 is to explain the a starting timing of a starter in a second embodiment of the present invention.

FIG. 8 is a graph of a temporal change in crank speed by the initial combustion in the expansion-stroke-cylinder and in starter speed. The rotational speed is plotted on the y-axis and the time is plotted on the x-axis.

The rotational speed of the crank indicated by a curve 10 is accelerated by the initial combustion to attain a predetermined speed and drops thereafter. The data for the changes in the rotational speed of the crank as indicated by the curve 10 is registered in the map through the previous measurement.

As shown in FIG. 8, a period during which the crank speed is increasing is an acceleration period 11, and a period during which it is decreasing is a deceleration period 12.

Broken lines 13*a* to 13*c* (lines 13*a* to 13*c*) of FIG. 8 indicate rotational speeds of the starter motor, respectively. The lines 13*a* to 13*c* have a different point from one another only in a starting timing of the starter motor.

As explained above, the starter and the engine are engaged with each other desirably when a difference between their rotational speeds is small. Therefore, the crank and the starter are engaged with each other (gears of the two are engaged with each other) when the rotational speed of the crank indicated by the curve 10 is equal to each of the rotational speeds of the starter indicated by the respective lines 13*a* to 13*c*.

After the starter is engaged with the crank, the crank is accelerated by the starter because the rotational speed of the starter is faster. In other words, if the crank is engaged with the starter started at the timing indicated by the line 13*a*, the rotational speed of the crank changes as indicated by a thick line 11*a*. Likewise, if the crank is engaged with the starter started at the timing indicated by the line 13*b*, the rotational speed of the crank changes as indicated by a thick line 11*b*. Furthermore, if the crank is engaged with the starter started at the timing indicated by the line 13*c*, the rotational speed of the crank changes as indicated by a thick line 11*c*.

If the change (acceleration) in the rotational speed of the crank is smaller before and after the engagement with the starter, the shock caused by the engagement is smaller, and noise and abrasion caused by the engagement of the gears are smaller. Of the changes indicated by the thick lines 11*a* to 11*c*, the change indicated by the thick line 11*a* causes the smallest shock, while the change indicated by the thick line 11*c* causes the largest shock.

The starter is engaged with the engine while accelerating the starter. Therefore, the starter is desirably engaged with the engine when the rotation of the engine is accelerated by the initial combustion (the acceleration period 11) because the shock caused by the engagement is reduced.

As explained above, the timing of starting the starter needs to be controlled according to the timing of starting the engine by the initial combustion. However, in order to prevent delay in starting of the starter, it is required to generate a signal to make the starter start before the engine is started by the initial combustion. In the conventional technology, it is determined whether the starter assist is required after the engine is started. Therefore, the starter cannot be started at the optimal timing.

In a third embodiment of the present invention, an energizing time of the starter motor, in the first and second embodiments, is determined as a minimum amount required for the piston of a following cylinder, which follows the cylinder in which initial combustion is performed (expansion-stroke-cylinder), to exceed the TDC of the compression stroke. If the piston of the follower cylinder exceeds the TDC of the compression stroke, there is no need for starter assist any more, and therefore, the energizing time is set accordingly.

When ignition is performed in the follower cylinder, new traction is generated, which allows the starter assist to be stopped. In the example, it is adequate that the starter assist is kept only until the crank in the follower cylinder is moved (120-B) degrees and exceeds the TDC of the compression stroke. Therefore, the energizing time of the starter motor is set to an amount corresponding to the amount of starter assist. As explained above, it is possible to determine whether the starter assist should be stopped based on the position of the crank, that is, whether the crank is rotated (120-B) degrees.

Figure 9:
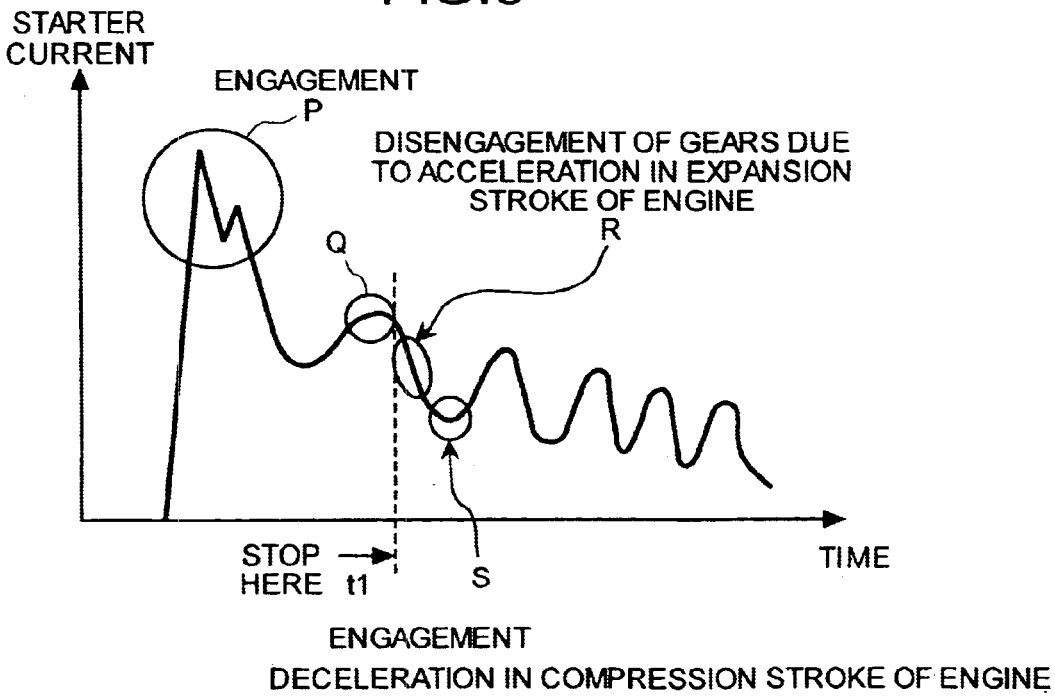
FIG. 9 is to explain temporal change in current passing through the starter when it is engaged with the engine.

FIG. 9 is a graph of temporal change in a current (starter current) passing in the starter motor when the starter starts the engine when the engine is at rest, as is conventionally performed.

As shown in FIG. 9, the engagement of the starter with the engine causes the starter motor to decelerate, and thereby the starter current abruptly drops and slightly increases right after the drop (area P).

After the engagement with the engine, the starter current vibrates vertically just like being wavy a plurality of times. When the starter current is increasing it means that the engine is in the compression stroke to cause the load to increase (area Q). When the starter current is decreasing it means that the piston exceeds the TDC of the compression stroke to cause the load to decrease (area R). In the area R, the engine is in the expansion stroke, and the engine is accelerated by the combustion power to be once disengaged from the starter, and accordingly, the gears are disengaged.

In an area S where the starter current has decreased to the low level and starts increasing again, the engine enters into the compression stroke to cause the engine speed to be decreased. As a result, the engine is engaged with the starter again.

In the third embodiment, the fuel injection and ignition are performed in the expansion-stroke-cylinder to cause the crank to start its rotation, and the starter is engaged with the crank while accelerating the starter. This point is different from the conventional method of engaging the starter with the crank when it is at rest and starting the rotation of the crank. However, as shown in FIG. 9, the temporal change in the starter current after the starter is engaged with the engine (the curve after the area P) is the same as that of the third embodiment.

As explained above, the energizing time of the starter motor is set so that the starter assist is performed until the piston in the follower cylinder exceeds the TDC of the compression stroke but is not performed after the piston has exceeded the TDC. Therefore, in the third embodiment, energization of the starter may be stopped at a timing t1 at which the current exceeds a peak of the current in the area Q, indicating that the piston exceeds the TDC of the compression stroke in FIG. 9. As explained above, it is possible to determine at which the starter assist is to be stopped based on the temporal change in the starter current.

Figure 10:
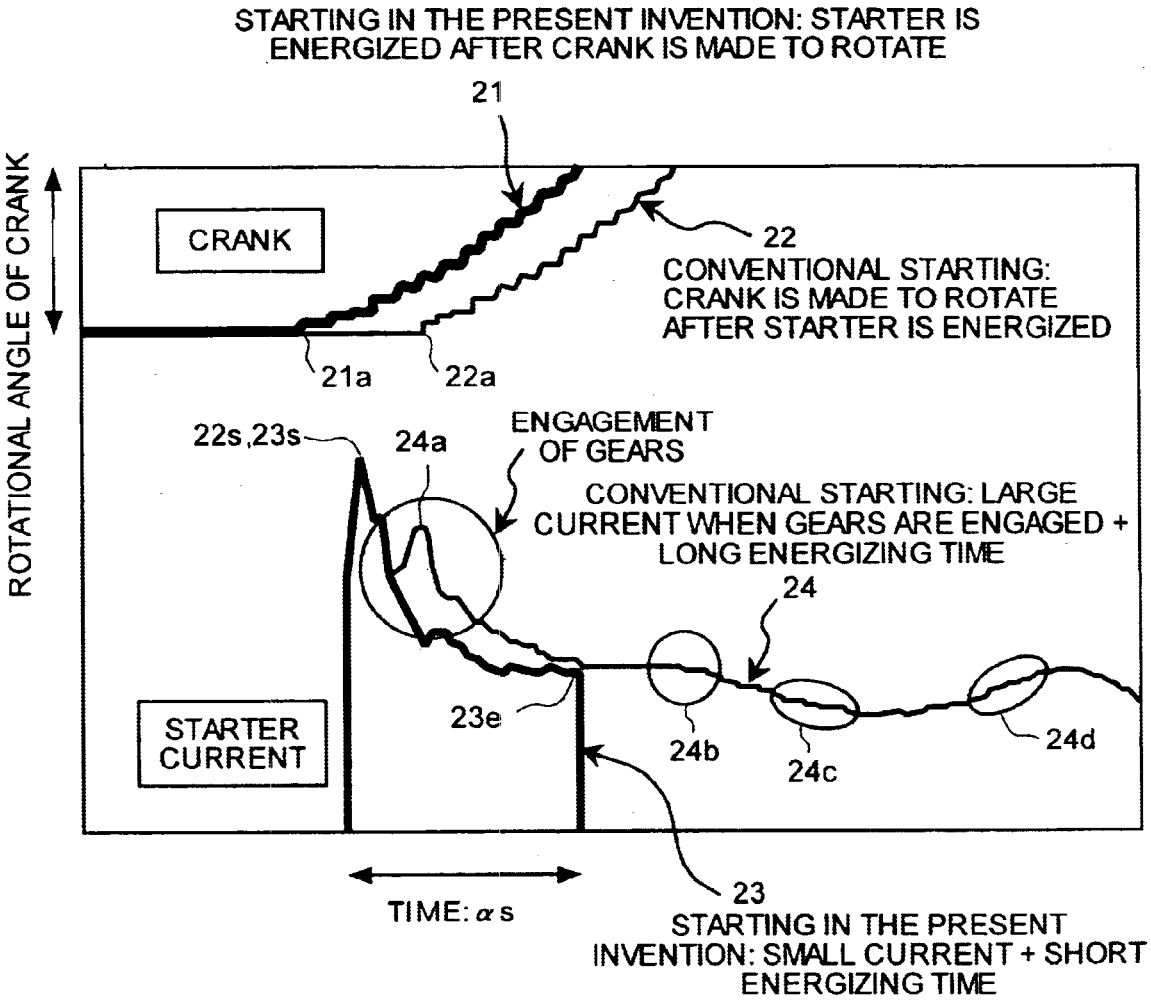
FIG. 10 is a graph of respective behaviors of a starter current and a rotation of the crank at the starting time in a third embodiment of the present invention and in the conventional technology.

FIG. 10 is a graph of behaviors of the starter current and the rotation of the crank at the time of starting the engine.

Reference numeral 21 represents temporal change in the rotational angle of the crank in the third embodiment, and reference numeral 22 represents temporal change in the rotational angle of the conventional crank. Reference numeral 23 represents temporal change in current values of the starter current in the third embodiment, and reference numeral 24 represents temporal change in current values of the starter current in the conventional technology.

Conventionally, after the current starts to pass through the starter (point 22*s*), the starter causes the rotation of the crank when it is at rest to start (point 22*a*). The rising edge of the point 22*a* matches the timing of a peak 24*a* of a line 24. This indicates that the gears are engaged with each other to cause the rotation of the crank to start. At this moment, a large current temporarily passes through the starter. An area 24*b* indicates that the load is so large that the piston exceeds the TDC of the compression stroke, and an area 24*c* indicates that the load is small because of the expansion stroke. An area 24*d* indicates that the load is large because of a next compression stroke.

In the third embodiment, the current starts to pass through the starter (point 23*s*), at the timing at which the crank is starts to rotate (point 21*a*) and acceleration has started. Note that the magnitude of the current that starts to pass through the starter is the same as that in the conventional technology (points 22*s* and 23*s*).

Because the starter is engaged with the crank accelerated while accelerating the starter, the load applied to the starter at the time of engagement is not large at all. This prevents excess current to be passed through the starter.

A point 23*e* indicates a timing at which the energization of the starter is stopped. Before the point 23*e*, there is a portion indicating that the load increases in the compression stroke, and that the current value increases and then exceeds the TDC of the compression stroke, and that the load decreases and the current value starts to decrease. The point 23*e* is a timing at which the starter current starts to decrease. As explained above, it is determined whether the starter assist is stopped based on the temporal change in the starter current.

In the third embodiment, the starter is engaged with the crank accelerated while accelerating the starter, and therefore, the timing at which the piston exceeds the TDC is earlier (point 23*e* and area 24*b*) than that of the conventional method. Under the same condition, the energizing time of the conventional starter is slightly shorter than one second while the energizing time of the starter in the third embodiment can be suppressed to $\alpha$ seconds (point 23*e*).

As explained above, there are two methods: the method of determining the stopping based on the position of the crank and the method of determining the stopping based on the change in the current value passing through the starter. In addition, the energizing time can be set as a predetermined time after the starter is started, considering that the starting of the starter when it is at rest may be delayed. In other words, when the starter is to be stopped is determined based on the position of the crank, it is first detected that the crank is positioned at a predetermined angle ((120-B) degrees) and then the starter is stopped. It should be noted that the starter actually stops after a delay time in the starting elapses from the time when a stop signal is sent to the starter. In this method, an actual energizing time may sometimes exceed the required minimum time.

Therefore, the rotational angle of the crank corresponding to the energizing time of the starter is previously measured to obtain the results of measurement as a map. In other words, in the example, an energizing time of the starter in order to obtain the rotational angle of the crank of (120-B) degrees is obtained from the map. Therefore, by energizing the starter only that time, it is possible to suppress the energizing time to the required minimum without influence of delay in the starting.

According to the third embodiment, it is possible to reduce the energizing time of the starter to a required minimum time, and to reduce power consumption.

If the combustion in the follower cylinder has failed or if the combustion power of the combustion in the follower cylinder is not adequate, combustions in the cylinder thereafter cannot take place, and thereby it is sometimes impossible to start the engine.

In a fourth embodiment of the present invention, when it is determined, using the technique of the first to third embodiments, that the piston in a cylinder (hereinafter, "third cylinder) that follows the follower cylinder does not exceed the TDC of the compression stroke after the piston in the follower cylinder that follows the cylinder with initial combustion exceeds the TDC of the compression stroke, the starter motor is started.

Concretely, it is determined whether the piston in the third cylinder exceeds the TDC of the compression stroke by detecting the rotational speed or the number of revolutions of the engine, or the rotational acceleration of the engine.

Two cases can be considered before the starter motor is started in order that the piston of the third cylinder exceeds the TDC of the compression stroke. As one case, the piston in the follower cylinder that follows the cylinder with initial combustion exceeds the TDC of the compression stroke only by the initial combustion without starting of the starter. As second case, the piston in the follower cylinder exceeds the TDC of the compression stroke by assisting the initial combustion with the starter.

In the fourth embodiment, as specifically explained in the third embodiment, the energization of the starter is stopped once when the piston of the follower cylinder has exceeded the TDC of the compression stroke. However, if it is determined thereafter that the piston of the third cylinder does not exceed the TDC of the compression stroke, the starter motor is made to restart.

According to the fourth embodiment, the engine can be started even if no combustion occurs in the follower cylinder or if the combustion power is not adequate.

Furthermore, according to the fourth embodiment, the energizing time of the starter can be reduced to a minimum time, which allows reduction in power consumption, as compared with the conventional starting method of keeping the starter energized until the starting is complete.

In the fourth embodiment, the starter motor is started for the third cylinder during rotation of the crank, and the energizing time of the starter motor is determined as a required amount for the piston in the third cylinder to exceed the TDC of the compression stroke. In a fifth embodiment of the present invention, this is realized in the same manner as that of the third embodiment.

The fifth embodiment of the present invention provides advantageous as explained below.

Lesser current is consumed because the starter is engaged with the engine rotating.

Lesser shock is caused when the gears engage with each other, and therefore, both noise and abrasion are kept at a low level.

Reduction in power consumption becomes possible because the energizing time of the starter can be reduced to minimum.

In a sixth embodiment of the present invention, each operation of the fourth and the fifth embodiments is performed until the engine can operate by itself without assistance of an external power. In a sixth embodiment of the present invention, the determination is made by detecting the rotational speed or the number of revolutions of the engine or the rotational acceleration of the engine.

The sixth embodiment of the present invention provides advantageous as explained below.

The engine can be started even if no combustion takes place in the third cylinder and the cylinders thereafter.

The energizing time of the starter is reduced to minimum, which allows reduced power consumption, as compared with that of the conventional starting method in which the starter is kept energized until the starting is complete.

Figure 11:
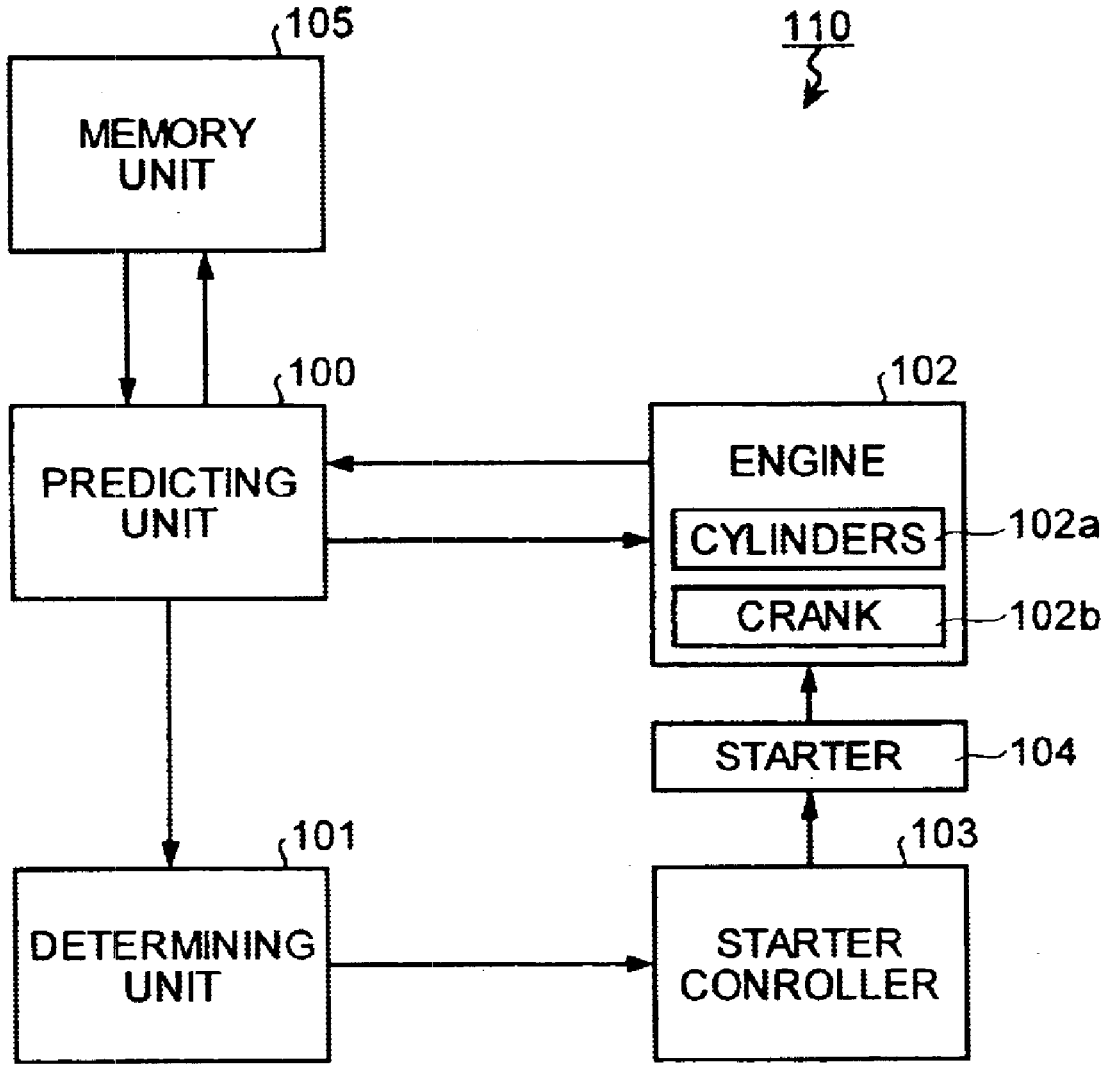
FIG. 11 is a functional block diagram of a starting device 110 according to a seventh embodiment of the present invention.

FIG. 11 is a functional block diagram of a starting device 110 according to a seventh embodiment of the present invention. The starting device 110 includes a predicting unit 100, a determining unit 101, a starter controller 103, a starter 104, and a memory unit 105. The starting device 110 controls an engine 102. The engine 102 includes a plurality of cylinders 102*a* and a crank 102*b* that moves pistons (not shown) inside the cylinder. Various types of sensors (not shown) measure various physical properties of the engine. For example, a temperature sensor (not shown) measures temperature of the water in the engine.

The memory unit 105 stores the various maps mentioned above. The predicting unit 100 predicts a state of the crank 102*b* based on various parameters (for example, crank position, and water temperature) and the maps stored in the memory unit 105. The determining unit determines whether the engine 102 will start by just the combustion power or the starter 104 is required to start the engine 102. If the starter is required, the determining unit 101 sends a signal (not shown) to the starter controller 103. The starter controller 103 provides a control to start the starter 104.

According to the starting device for the internal combustion engine according to the present invention, the starter is started at an optimal timing, which allows improved startability for ignition of fuel supplied to the expansion-stroke-cylinder.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A starting device for an internal combustion engine that ignites fuel in an expansion-stroke-cylinder that is a cylinder in an expansion stroke from among a plurality of cylinders of the internal combustion engine to start the internal combustion engine, comprising:

a predicting unit that predicts a state of a crank of the cylinders if the fuel in the expansion-stroke-cylinder is ignited; and a determining unit that determines whether to start a starter to assist movement of the crank based on the state predicted.

2. The starting device according to claim 1, wherein the predicting unit predicts a state of the crank before a first ignition is performed in the expansion-stroke-cylinder, and the determining unit determines whether the starter is to be started before the first ignition is performed in the expansion-stroke-cylinder.

3. The starting device according to claim 1, wherein the predicting unit estimates the state of the crank based on a stop position of the crank and a water temperature in the internal combustion engine.

4. The starting device according to claim 1, wherein the predicting unit estimates combustion power produced if the fuel in the expansion-stroke-cylinder is ignited, and predicts the state of the crank based on the combustion power estimated.

5. The starting device according to claim 4, wherein the predicting unit estimates an amount of oxygen in the expansion-stroke-cylinder and estimates the combustion power based on the amount of oxygen estimated.

6. The starting device according to claim 5, wherein the predicting unit estimates the amount of oxygen based on a stop position of the crank corresponding to air capacity in the expansion-stroke-cylinder.

7. The starting device according to claim 5, wherein the predicting unit estimates air density in the expansion-stroke-cylinder, and estimates the amount of oxygen based on the air density estimated.

8. The starting device according to claim 7, wherein the predicting unit estimates the air density based on a water temperature in the internal combustion engine.

9. The starting device according to claim 4, wherein the predicting unit estimates frictional force produced if the fuel in the expansion-stroke-cylinder is ignited, and predicts the state of the crank based on both the frictional force estimated and the combustion power estimated.

10. The starting device according to claim 9, wherein the predicting unit estimates the frictional force based on friction produced when the crank rotates and a compression work in a follower cylinder that follows the expansion-stroke-cylinder.

11. The starting device according to claim 10, wherein the predicting unit estimates the frictional force based on a stop position of the crank that corresponds to the compression work in the follower cylinder.

12. The starting device according to claim 10, wherein the predicting unit estimates oil viscosity corresponding to the friction, and estimates the frictional force based on the oil viscosity estimated.

13. The starting device according to claim 12, wherein the predicting unit estimates the oil viscosity based on a water temperature in the internal combustion engine.

14. The starting device according to claim 1, wherein the state of the crank is either of a rotational angle of the crank and number of revolutions of the internal combustion engine.

15. The starting device according to claim 1, further comprising a starter controller that controls the starter upon receiving a trigger from the determining unit when the determining unit determines that the starter is to be started, wherein the starter controller provides a control to start the starter after the fuel in the expansion-stroke-cylinder has been ignited.

16. The starting device according to claim 1, further comprising a starter controller that controls the starter upon receiving a trigger from the determining unit when the determining unit determines that the starter is to be started, wherein the starter controller provides a control to start the starter at a timing such that the starter and the internal combustion engine get coupled to each other when the crank is in a state of acceleration.

17. The starting device according to claim 1, further comprising a starter controller that controls the starter upon receiving a trigger from the determining unit when the determining unit determines that the starter is to be started, wherein the starter controller provides a control to supply a current to the starter so that the current supplied has a minimum magnitude required for a piston in a follower cylinder that follows the expansion-stroke-cylinder to exceed a top dead center of an compression stroke.

18. The starting device according to claim 1, further comprising a starter controller that controls the starter upon receiving a trigger from the determining unit when the determining unit determines that the starter is to be started, wherein the starter controller provides a control to start the starter at such a timing that, when the starter is started and stopped after certain time but started second time because it is determined that the rotating state of the crank needs to restart the starter, a starting timing of the second time is adjusted such that the starter is coupled to the internal combustion engine during rotation of the crank.

19. A method of starting an internal combustion engine that includes igniting fuel in an expansion-stroke-cylinder that is a cylinder in an expansion stroke from among a plurality of cylinders of the internal combustion engine to start the internal combustion engine, comprising:

predicting a state of a crank of the cylinders if the fuel in the expansion-stroke-cylinder is ignited; and determining whether to start a starter to assist movement of the crank based on the state predicted.

20. The method according to claim 19, wherein the predicting is carried out before a first ignition is performed in the expansion-stroke-cylinder, and the determining is carried out before the first ignition is performed in the expansion-stroke-cylinder.

* * * * *